US009982893B2

(12) United States Patent
Rodriguez et al.

(10) Patent No.: US 9,982,893 B2
(45) Date of Patent: May 29, 2018

(54) COMBUSTOR ARRANGEMENT INCLUDING FLOW CONTROL VANES

(71) Applicant: Siemens Energy, Inc., Orlando, FL (US)

(72) Inventors: Jose L. Rodriguez, Lake Mary, FL (US); Matthew J. Golsen, Deltona, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 0 days. days.

(21) Appl. No.: 15/506,055

(22) PCT Filed: Sep. 5, 2014

(86) PCT No.: PCT/US2014/054214

§ 371 (c)(1),
(2) Date: Feb. 23, 2017

(87) PCT Pub. No.: WO2016/036381

PCT Pub. Date: Mar. 10, 2016

(65) Prior Publication Data

US 2017/0284679 A1 Oct. 5, 2017

(51) Int. Cl.

| | |
|---|---|
| ***F23R 3/04*** | (2006.01) |
| ***F23R 3/42*** | (2006.01) |
| ***F23R 3/54*** | (2006.01) |

(52) U.S. Cl.

CPC ..... *F23R 3/425* (2013.01); *F23R 3/04* (2013.01); *F23R 3/54* (2013.01); *F23R 2900/03043* (2013.01); *F23R 2900/03045* (2013.01)

(58) Field of Classification Search

CPC .... F23R 3/04; F23R 3/54; F23R 2900/03043; F23R 2900/03045; F23R 3/08; F23R 3/10–3/14

(Continued)

(56) References Cited

U.S. PATENT DOCUMENTS 2,601,000 A 6/1952 Nerad
4,090,360 A * 5/1978 Erismann ..... F23R 3/26 60/758

(Continued)

FOREIGN PATENT DOCUMENTS

EP 2204614 A2 7/2010
EP 2375156 A2 12/2011

(Continued)

OTHER PUBLICATIONS

PCT International Search Report and Written Opinion dated May 4, 2015 corresponding to PCT Application No. PCT/US2014/054214 filed Sep. 5, 2014.

*Primary Examiner* — Gerald L Sung
*Assistant Examiner* — Rene Ford

(57) ABSTRACT

A combustor assembly (17) including guide vanes (44) located between an inner cylinder (24) and a flow sleeve (25). Each guide vane (44) includes a circumferentially angled flow directing portion (60) adjacent to a leading edge (46). The leading edge (46) of at least one guide vane (44) can be located radially inward along the longitudinal axis (54) relative to the leading edge (46) of at least one other of the guide vanes (44). The length of the guide vanes (44) may vary, and the circumferential spacing between a first pair of the guide vanes (44) can be different from a spacing between a second pair of the guide vanes (44).

19 Claims, 7 Drawing Sheets

(58) Field of Classification Search
USPC ..... 60/759
See application file for complete search history.

(56) References Cited

U.S. PATENT DOCUMENTS 4,129,985 A * 12/1978 Kajita ..... F23R 3/02 60/39.37
7,685,823 B2 3/2010 Martling et al.
7,721,547 B2 5/2010 Bancalari et al.
8,091,365 B2 1/2012 Charron
8,113,003 B2 2/2012 Charron et al.
8,276,389 B2 * 10/2012 Charron ..... F01D 9/023 60/39.37
8,516,822 B2 * 8/2013 Chen ..... F23R 3/005 60/752
2010/0077719 A1 * 4/2010 Wilson ..... F23R 3/425 60/39.37
2010/0170259 A1 7/2010 Huffman
2012/0031099 A1 * 2/2012 Bathina ..... F23R 3/005 60/746
2012/0297784 A1 11/2012 Melton et al.
2013/0086921 A1 * 4/2013 Matthews ..... F23R 3/005 60/782
2013/0091848 A1 4/2013 Manoharan et al.
2014/0060063 A1 * 3/2014 Boardman ..... F23R 3/286 60/772
2014/0090385 A1 * 4/2014 Kodukulla ..... F23R 3/002 60/756
2015/0101336 A1 * 4/2015 Numata ..... F23R 3/44 60/755
2015/0267918 A1 * 9/2015 Maurer ..... F02C 3/04 60/726
2015/0369486 A1 * 12/2015 Yokota ..... F15D 1/009 60/754

FOREIGN PATENT DOCUMENTS

JP H1082527 A 3/1998
JP 2000146186 A 5/2000

* cited by examiner

COMBUSTOR ARRANGEMENT INCLUDING FLOW CONTROL VANES

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The present invention relates in general to turbine engines and, more particularly, to a combustor arrangement for producing a hot working gas that is conveyed from a combustor to turbine blades in a gas turbine engine.

BACKGROUND OF THE INVENTION

A gas turbine engine typically includes a compressor section, a combustion section including a plurality of combustors, and a turbine section. Ambient air is compressed in the compressor section and conveyed to the combustors in the combustion section. The combustors combine the compressed air with a fuel and ignite the mixture creating combustion products defining hot working gases that flow in a turbulent manner and at a high velocity. The working gases are routed to the turbine section via a plurality of gas passages, conventionally referred to as transition ducts. Within the turbine section are rows of stationary vane assemblies and rotating blade assemblies. The rotating blade assemblies are coupled to a turbine rotor. As the working gases expand through the turbine section, the working gases cause the blade assemblies, and therefore the turbine rotor, to rotate. The turbine rotor may be linked to an electric generator, wherein the rotation of the turbine rotor can be used to produce electricity in the generator.

The compressed air is routed between a flow sleeve and an inner cylinder of a respective combustor to provide the air for combustion in a combustion zone surrounded by the inner cylinder. The gas passages each include an inlet positioned adjacent to a respective combustor, and each gas passage routes a flow of working gases into the turbine section through a turbine inlet structure associated with a first row of turbine vanes.

SUMMARY OF THE INVENTION

In accordance with an aspect of the invention, a combustor arrangement is provided in a can annular gas turbine engine. The gas turbine engine has a gas delivery structure for delivering gases from a plurality of combustors to an annular chamber that extends circumferentially and is oriented concentric to a gas turbine engine axis for delivering the gas flow to a first row of blades. A gas flow path is formed by a duct arrangement between a respective combustor and the annular chamber for conveying gases in a downstream direction from each combustor to the first row of turbine blades. The combustor arrangement comprises a combustor having an inner cylinder surrounding a combustion zone of the combustor. The inner cylinder defines a longitudinal axis of the combustor that is oriented in a radially inward and circumferentially angled direction toward the annular chamber. A cone section is provided having an inlet end receiving the gas flow from the inner cylinder, wherein the cone section defines a decreasing flow area in the downstream direction. A flow sleeve surrounds the inner cylinder, and an annular space is defined between the inner cylinder and the flow sleeve and defines an air flow path having an annular air inlet defined along the inner cylinder radially inward of a junction between the inner cylinder and the cone section. A plurality of guide vanes are located in circumferentially spaced relation to each other in the annular space, spanning between the flow sleeve and the inner cylinder. The guide vanes each have a length dimension defined between a radially inner leading edge and a radially outer trailing edge, wherein the leading edges of the guide vanes are located along the longitudinal axis radially inward from the junction between the inner cylinder and the cone section.

The leading edge of at least one guide vane can be located radially inward along the longitudinal axis relative to the leading edge of at least one other of the guide vanes.

Air flowing into the annular space can have a circumferential swirl flow direction around a circumference of the inner cylinder, and the at least one guide vane can be located in an upstream direction of the swirl flow from the at least one other of the guide vanes.

At least two of the guide vanes can have leading edges located radially inward along the longitudinal axis relative to at least two other of the guide vanes. The at least two of the guide vanes can have trailing edges located radially inward along the longitudinal axis relative to the trailing edges of the at least two other guide vanes.

A first guide vane can be circumferentially located at an upstream-most location and can have a leading edge at a radially inward location relative to all of the other guide vanes, and can have a length that is less than half the length of the other guide vanes.

A first guide vane can be circumferentially located at an upstream-most location and can be spaced from an adjacent guide vane a distance that is less than a circumferential spacing between other adjacent guide vanes.

Each of the guide vanes include a circumferentially angled flow directing portion and an angle of each of the circumferentially angled flow directing portions of the at least two guide vanes, as measured relative to the longitudinal axis, can be greater than an angle of each of the circumferentially angled flow directing portions of the at least two other of the guide vanes.

All of the guide vanes can be located in a circumferential area that is less than 180 degrees around the circumference of the inner cylinder.

A radially inner end of the flow sleeve can be located radially inward from the junction between the inner cylinder and the cone section.

One or more of the guide vanes can include a straight main body aligned parallel to the longitudinal axis of the combustor and extending from the trailing edge to a radially inner intermediate location, and a circumferentially angled flow directing portion extending from the intermediate location to the leading edge.

In accordance with another aspect of the invention, a combustor arrangement is provided in a can annular gas turbine engine. The gas turbine engine has a gas delivery structure for delivering gases from a plurality of combustors to an annular chamber that extends circumferentially and is oriented concentric to a gas turbine engine axis for delivering the gas flow to a first row of blades. A gas flow path is formed by a duct arrangement between a respective combustor and the annular chamber for conveying gases in a downstream direction from each combustor to the first row of turbine blades. The combustor arrangement comprises a combustor having an inner cylinder surrounding a combustion zone of the combustor. The inner cylinder defines a longitudinal axis of the combustor that is oriented in a radially inward and circumferentially angled direction toward the annular chamber. A cone section is provided having an inlet end receiving the gas flow from the inner cylinder, wherein the cone section defines a decreasing flow area in the downstream direction. A flow sleeve surrounds the inner cylinder, and an annular space is defined between the inner cylinder and the flow sleeve and defines an air flow path having an annular air inlet defined along the inner cylinder radially inward of a junction between the inner cylinder and the cone section. A plurality of guide vanes are located in circumferentially spaced relation to each other in the annular space, spanning between the flow sleeve and the inner cylinder. The guide vanes each have a length dimension defined between a radially inner leading edge and a radially outer trailing edge, wherein the leading edge of at least one guide vane is located radially inward along the longitudinal axis relative to the leading edge of at least one other of the guide vanes.

Air flowing into the annular space can have a circumferential swirl flow direction around a circumference of the inner cylinder, and the at least one guide vane can be located in an upstream direction of the swirl flow from the at least one other of the guide vanes.

A first pair of the guide vanes can have leading edges located radially inward along the longitudinal axis relative to a second pair of the guide vanes, and the first pair of guide vanes can be located in the upstream direction of the swirl flow from the second pair of guide vanes. A first, upstream-most guide vane of the first pair of guide vanes can have a length that is less than the length of the other guide vanes.

Each of the guide vanes can include a circumferentially angled flow directing portion and an angle of the circumferentially angled flow directing portions of each of the guide vanes in the first pair of guide vanes, as measured relative to the longitudinal axis, can be greater than an angle of each of the circumferentially angled flow directing portions of the guide vanes in the second pair of guide vanes.

In accordance with a further aspect of the invention, a combustor arrangement is provided in a can annular gas turbine engine. The gas turbine engine has a gas delivery structure for delivering gases from a plurality of combustors to an annular chamber that extends circumferentially and is oriented concentric to a gas turbine engine axis for delivering the gas flow to a first row of blades. A gas flow path is formed by a duct arrangement between a respective combustor and the annular chamber for conveying gases in a downstream direction from each combustor to the first row of turbine blades. The combustor arrangement comprises a combustor having an inner cylinder surrounding a combustion zone of the combustor. The inner cylinder defines a longitudinal axis of the combustor that is oriented in a radially inward and circumferentially angled direction toward the annular chamber. A cone section is provided having an inlet end receiving the gas flow from the inner cylinder, wherein the cone section defines a decreasing flow area in the downstream direction. A flow sleeve surrounds the inner cylinder, and an annular space is defined between the inner cylinder and the flow sleeve and defines an air flow path having an annular air inlet defined along the inner cylinder radially inward of a junction between the inner cylinder and the cone section. A plurality of guide vanes are located in circumferentially spaced relation to each other in the annular space, spanning between the flow sleeve and the inner cylinder. The guide vanes each have a length dimension defined between a radially inner leading edge and a radially outer trailing edge. Each guide vane includes a circumferentially angled flow directing portion, wherein air flowing into the annular space has a circumferential swirl flow direction around a circumference of the inner cylinder, and a first pair of guide vanes are circumferentially spaced apart a distance that is less than a circumferential spacing between a second pair of guide vanes adjacent to the first pair of guide vanes. The first pair of guide vanes is located in an upstream direction of the swirl flow relative to the second pair of guide vanes.

Leading edges of the first pair of guide vanes can be located radially inward from leading edges of the second pair of guide vanes. A first, upstream-most guide vane of the first pair of guide vanes can have a length that is less than the length of the other guide vanes.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

One assembly of a system for delivery of hot working gases from combustors to a turbine section of a gas turbine engine, in accordance with an aspect of the invention, orients combustor cans of a gas turbine engine in a tangential arrangement. In particular, combustor cans of a can-annular combustor are each oriented to direct a hot working gas flow through an assembly of components defining gas passages that direct the individual gas flows in a radially inward and circumferentially angled direction into an annular chamber immediately upstream and adjacent a first row of turbine blades in a turbine section of the engine. For example, the arrangement of gas passages providing a flow to an annular chamber may generally correspond to a structure for supplying a flow of gases directly to a first row of turbine blades, without a need for row one turbine vanes as is described, for example, in U.S. Pat. No. 8,230,688 to Wilson et al. As described in the Wilson et al. patent, the gas passage can typically define a straight flow path extending from the combustor to the annular chamber.

Figure 1:
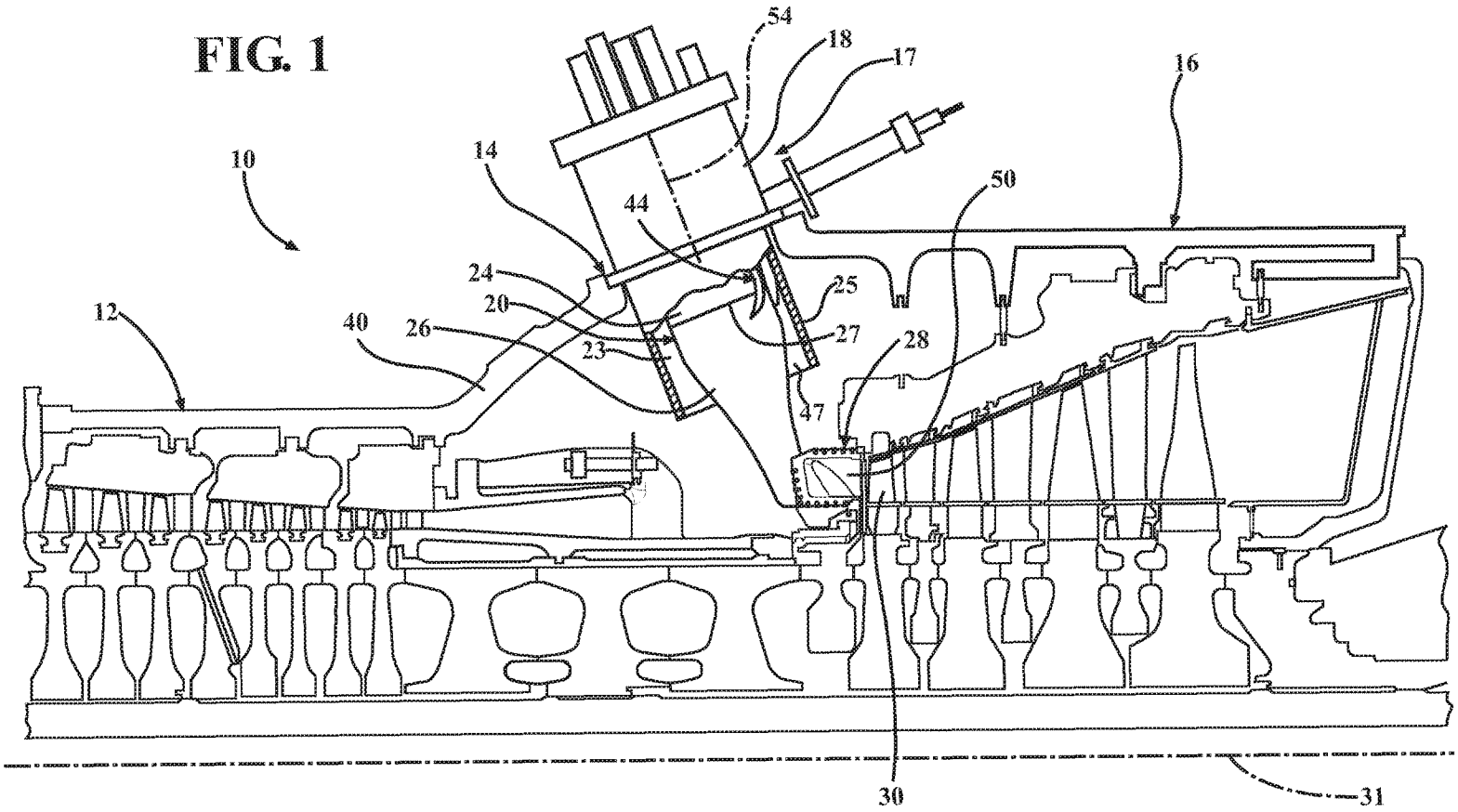
FIG. 1 is a cross-sectional view through a portion of a turbine engine illustrating aspects of the present invention.

Referring to FIG. 1, a gas turbine engine 10 is shown including a compressor section 12, a combustion section 14 and a turbine section 16. The compressor section 12 compresses ambient air and supplies the compressed air to a plurality of combustor arrangements or assemblies 17 in the combustion section 14 for combusting fuel and air and delivering the combustion products to the turbine section 16. In the illustrated embodiment, the combustor assemblies 17 each comprise a can-annular combustor 18, and incoming air to each combustor 18 flows through an annular passage 23 defined between an inner cylinder 24 and a flow sleeve 25 surrounding the inner cylinder 24. The combustors 18 combine the compressed air with fuel and ignite the mixture to create combustion products forming a hot working gas flow from each of the combustors 18. The gas flow is conveyed through a gas delivery structure formed by a duct arrangement of the combustor assembly 17, comprising individual gas paths 20 associated with each of the combustors 18, to an annular chamber 50 for delivering the gas flows from the combustors 18 to the turbine section 16.

A portion of the gas paths 20 is formed the inner cylinders 24 which are connected to and receive the gas flow from a respective combustor 18. A cone section 26 is connected to the inner cylinder 24 at a junction 27, and receives the gas flow from the inner cylinder 24 and defines a decreasing flow area in a downstream gas flow direction for conveying the gas flow to an integrated exit piece 28 (hereinafter referred to as an "IEP"). Each gas path 20 extends along a longitudinal axis 54 of the inner cylinder 24 oriented to direct the hot gas flow from the combustors 18 in a radially inward and circumferentially angled direction toward the IEPs 28, i.e., circumferentially angled relative to an axis 31 of the gas turbine engine 10. A plurality of IEPs 28 are provided, one for each combustor 18, and the plurality of IEPs 28 are connected to form an annular structure defining the annular chamber 50 forward of the turbine section 16. It may be noted that the turbine section 16 does not include a first row of vanes, and the annular structure delivers the gas flow in an aft direction directly to a first row of turbine blades 30 in the turbine section 16.

As used herein, "forward" refers to an engine inlet side, and "aft" or "rearward" refers to an engine exhaust side with respect to the axis 31 of the gas turbine engine 10. "Inner" and "outer" refer to radial positions with respect to the gas turbine engine axis 31. "Upstream" and "downstream" are used in a first instance with reference to the flow direction of the hot working gas passing through the inner cylinder 24, cone section 26 and IEP 28. "Upstream" and "downstream" can also be used in a second instance with reference to a flow direction of shell air forming a swirl flow passing in a circumferential direction around the outside of the inner cylinder 24 and the cone section 26 as the shell air passes into the annular passage 23 between the inner cylinder 24 and the flow sleeve 25. "Radially" and "radial direction" refer to a direction extending perpendicular to the axis 31 of gas turbine engine 10. "Circumferential" is used in a first instance with reference to a flow of swirl air passing around the outside of the inner cylinder 24 and the cone section 26, and "circumferential" can be used in a second instance with reference to a direction extending around the engine axis 31, and lying in a plane perpendicular to the engine axis 31.

Figure 2:
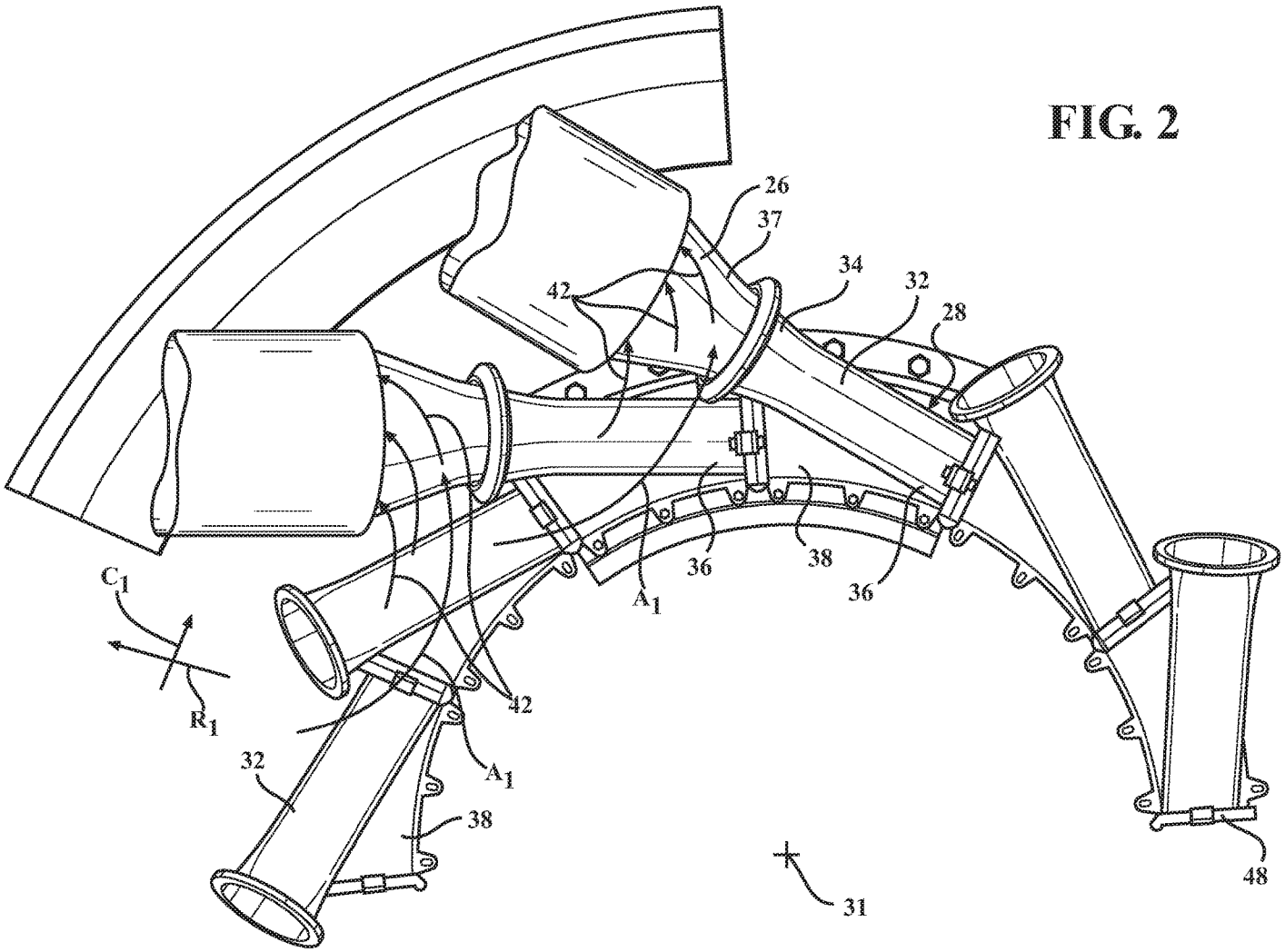
FIG. 2 is a perspective view, as viewed in an aft direction of the turbine engine, and illustrating a combustor arrangement in accordance with aspects of the invention.

As may be seen in FIG. 2, each IEP 28 can include an inlet section 32 having a generally rectangular cross-section, and having an upstream inlet end 34 and a downstream end 36, with reference to the flow of hot working gas in the gas path 20, wherein the inlet end 34 is joined to a downstream outlet end 37 of the cone section 26. A connection segment 38 is formed integrally with the inlet section 32 and is located at a radially inner side of the IEP 28. The connection segment 38 has a generally rectangular cross-section and is configured to form a junction with an adjacent IEP 28. The connected IEPs 28 form the annular chamber 50 (FIG. 1) that is open in the aft direction, extending circumferentially and oriented concentric to the axis 31 of the engine 10 for delivering the hot working gas flow to the first row of blades 30.

Referring to FIGS. 1 and 2, compressed air from the compressor 12 flows in an axially aft direction into a combustor shell 40, comprising shell air $A_1$ (FIG. 5) that is provided to the combustors 18. The direction of the shell air $A_1$ flowing to the combustors 18 has a radial directional component $R_1$ and a circumferential directional component $C_1$ as it enters the annular passage 23. The circumferential component $C_1$ of the shell air flow extends in the same circumferential direction as the circumferential orientation or angle of the gas paths 20.

It should be understood that the pressurized shell air entering the annular passage 23 forms a concentrated jet of air passing radially outward in the combustor assembly 17 between the inner cylinder 24 and the flow sleeve 25, which concentrated air is referred to herein as swirl air 42 as it enters and passes through the annular passage 23. That is, the swirl air 42 may be understood as being the portion of shell air $A_1$ entering an annular passage 23 of the combustor assembly 17. The air flowing into the annular passage 23 is substantially concentrated in the aft facing area of the annulus passage 23, wherein a portion of the shell air $A_1$ enters the annular passage 23 along a circumferential portion of the combustor assembly 17 that extends along the upstream (relative to direction $C_1$) and aft portions of the inner cylinder 24 and, in the absence of a flow control mechanism, can have a large amount of swirl, i.e., non-linear and directionally non-uniform flow, as it flows radially outward in the flow passage 23 toward an inlet passage in fluid communication with the interior flow passage of the inner cylinder 24. The noted circumferential portion of the combustor assembly 17 corresponds to an aft facing portion 39 of the inner cylinder 24, and may including an upstream facing portion 41 (relative to the circumferential direction $C_2$) of the inner cylinder 24, identified by circumferential area or section $S_1$ in FIG. 3. The swirl flow can have a circumferential flow direction $C_2$ (FIG. 3) within the flow passage 23 that can result in a non-uniform air flow entering the combustor 18, and which can consequently result in a destabilized combustion with increased NOx emissions and can increase the possibility of pressure oscillations.

Figure 3:
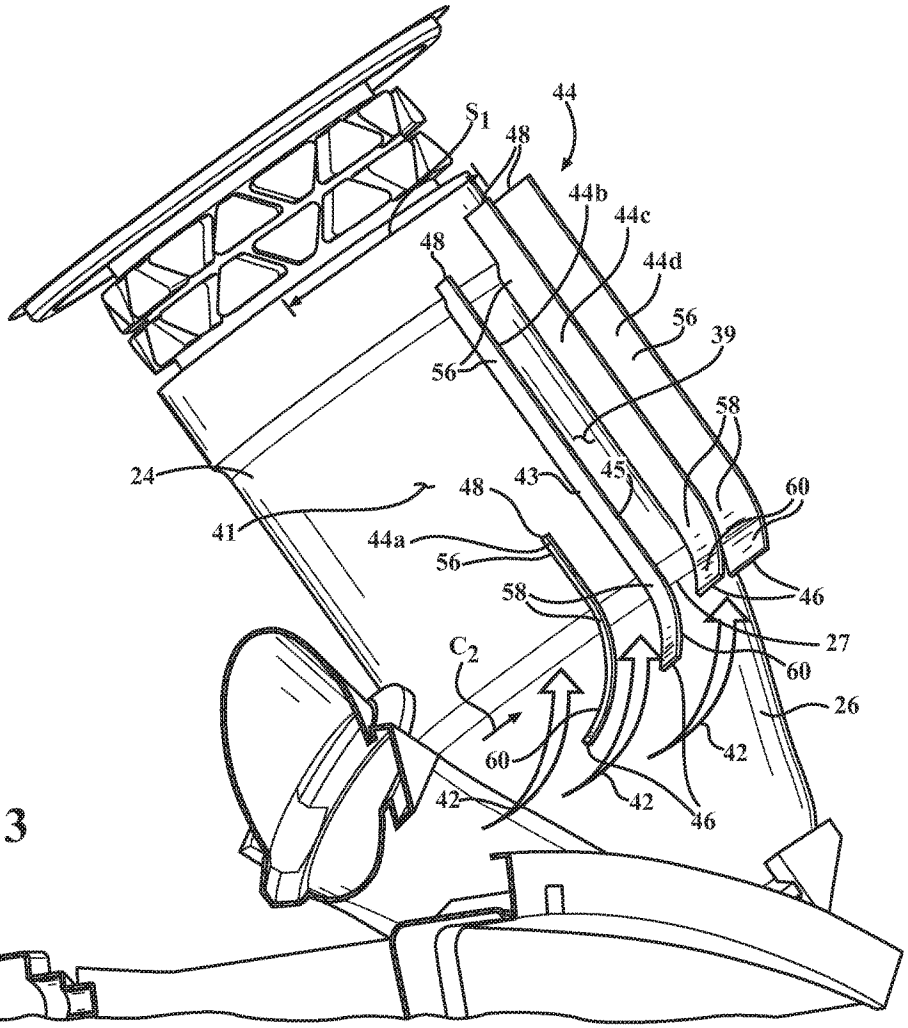
FIG. 3 is a perspective view of a combustor arrangement, shown with a flow sleeve removed, illustrating aspects of the invention including vanes having varying leading edge locations.
Figure 4:
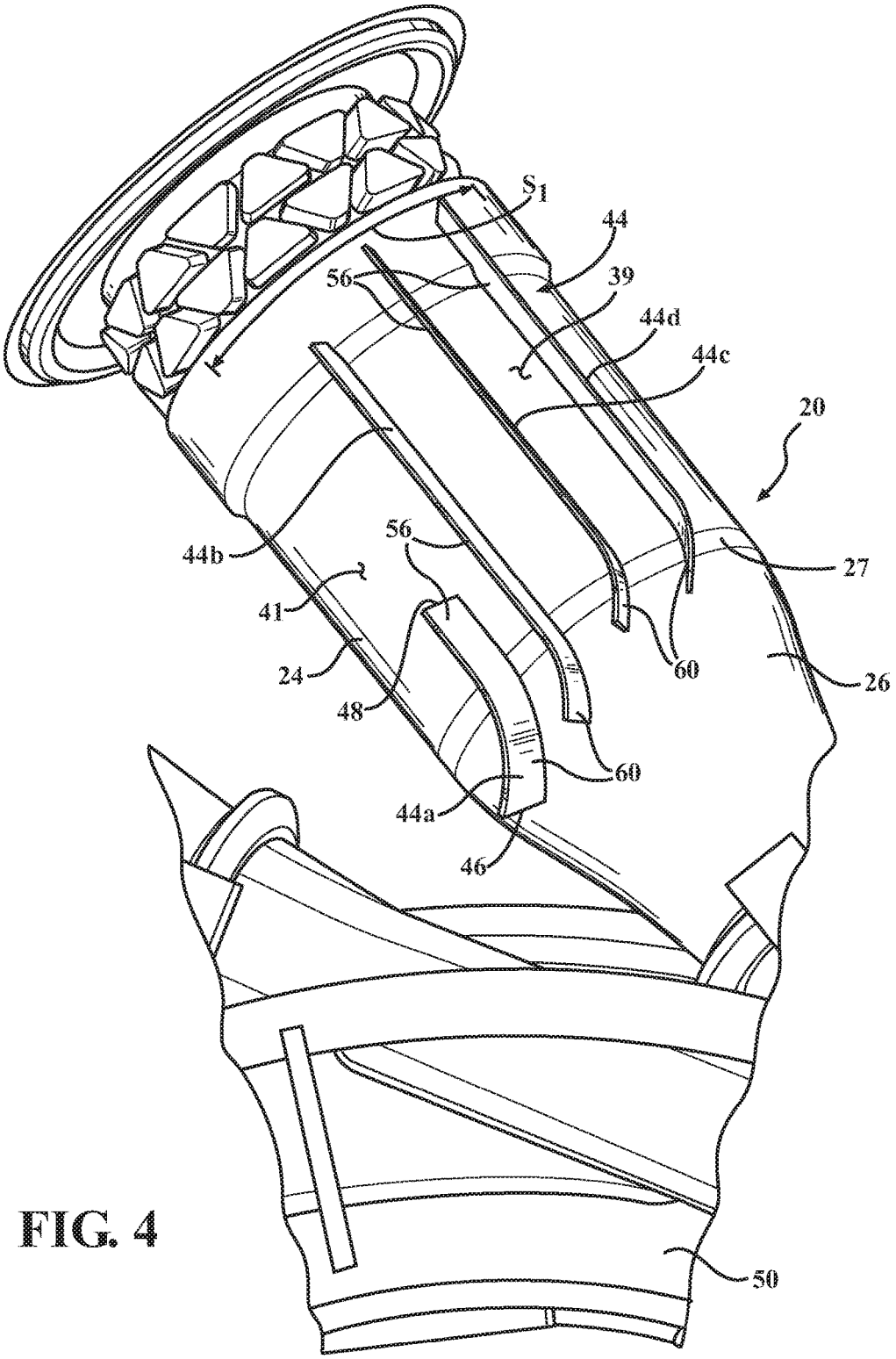
FIG. 4 is a perspective view of a combustor arrangement, shown with a flow sleeve removed, illustrating aspects of the invention including vanes having varying circumferential spacing.

Referring to FIGS. 3 and 4, an aspect of the invention includes providing a set of guide vanes 44 that can capture and redirect air to provide an increased uniform flow through the annular passage 23. In particular, a set of four guide vanes 44 are provided within the circumferential section $S_1$, and identified as guide vanes 44*a*, 44*b*, 44*c*, 44*d* respectively positioned in order from upstream to downstream locations relative to the circumferential flow direction $C_2$ within the flow passage 23. The guide vanes 44 extend radially through the flow passage 23 between first edges and second edges where they engage the inner cylinder 24 and flow sleeve 25, respectively, i.e., at inner (first) 43 and outer (second) 45 edge locations (FIG. 3) relative to a line extending perpendicular to the longitudinal axis 54 of the combustor inner cylinder 24. The guide vanes 44 can be rigidly attached to the inner cylinder 24 and the flow sleeve 25 at the first and second edge locations 43, 45 to provide a structural connection between the inner cylinder 24 and the flow sleeve 25.

The guide vanes 44 are positioned in circumferentially spaced relation to each other around a portion of the combustor assembly 17 that does not encompass the full circumference of the combustor assembly, which is preferably less than 180 degrees around the combustor assembly 17, and can preferably be located within a region extending about 90 degrees around the circumference of the combustor assembly 17. In particular, the guide vanes 44 are preferably located in the aft facing circumferential region defined by the circumferential section $S_1$.

Each guide vane 44 comprises an elongated thin plate having a uniform thickness between opposing planar flow surfaces, and having a length extending in the direction of the longitudinal axis 54 between a radially inner leading edge 46 and a radially outer trailing edge 48. The leading edge 46 is located in an annular entrance area or inlet 47 (FIG. 1) to the annular passage 23 at a longitudinal location radially inward from the junction 27 between the inner cylinder 24 and the cone section 26. That is, the leading edges 46 are positioned to interact with the shell air $A_1$ flowing around the combustor assemblies 17 and direct the air into the annular passage 23.

Each guide vane 44 can be configured with a straight main body 56 aligned parallel to the longitudinal axis 54 of the combustor inner cylinder 24, and extending from the trailing edge 48 to a radially inner intermediate location 58 that is located at or slightly radially outward from the junction 27. Each guide vane 44 can further include a circumferentially angled flow directing portion 60 extending from the intermediate location 58 to the leading edge 46. The flow directing portion 60 is angled relative to the longitudinal axis 54 to position the leading edge 46 upstream, i.e. relative to the circumferential flow direction $C_2$, from the main body 56. Further, the flow directing portion 60 can define a curved or arc shaped flow surface having a concave upstream side facing toward the incoming flow for guiding the initially circumferentially directed flow entering the inlet 47 into the annular passage 23. The angle of the flow directing portion 60 is defined with reference to a line extending tangent to the upstream side of the flow directing portion 60 at the leading edge 46. Alternatively, one or more of the guide vanes 44 can be formed with the circumferentially angled flow direction portion 60 extending the length of the guide vane 44, such as may be the case for one or more of the guide vanes 44 that have a shorter length than the other guide vanes 44, as described below.

In accordance with one aspect of the invention, the leading edge 46 of at least one of the guide vanes 44 is positioned at a longitudinal location that is radially inward from the longitudinal location of the leading edges 46 of the other guide vanes 44. In particular, at least a first, upstream-most guide vane 44*a* can have a leading edge 46 that is located radially inward along the longitudinal axis 54 from the other guide vanes 44*b*, 44*c*, 44*d*. As illustrated in FIG. 3, a subsequent second guide vane 44*b* can have a leading edge 46 located at a longitudinal location intermediate the location of the leading edge 46 of the first guide vane 44*a* and the leading edges of downstream third and fourth guide vanes 44*c*, 44*d*. Hence, the first and second guide vanes 44*a*, 44*b* can form a first pair of guide vanes 44 that have leading edges 46 located radially inward from the leading edges 46 of a subsequent second pair of guide vanes 44 formed by the third and fourth guide vanes 44*c*, 44*d*.

The leading edge 46 of each of the guide vanes 44 is the beginning of the air flow control surface for the respective vane 44. The longitudinally staggered locations of the leading edges 46 permits the guide vanes 44*a*, 44*b*, 44*c*, 44*d* to sequentially "peel" air flow from the concentrated jet of shell air $A_1$ for redistribution, such that the air flow passing through the annular passage 23 is more evenly distributed about the circumference of the combustor assembly 17 and is formed into a more uniform flow aligned parallel to the longitudinal axis 54. FIGS. 3 and 4 additionally illustrate that the circumferentially angled flow directing portion 60 of at least the first guide vane 44*a*, and optionally of the first and second guide vanes 44*a*, 44*b*, can be angled toward the circumferential direction more than the third and fourth guide vanes 44*c*, 44*d* to facilitate extracting a portion of the flow passing around the combustor assembly 17 for passage through the annular passage 23. That is, the leading edge entrance angle of the guide vanes 44 can vary to match the angle of the shell air flow around the combustor assembly 17, as depicted by the flow lines 42 in FIG. 3.

In accordance with another aspect of the invention, the first guide vane 44*a* can be formed with a length, measured in a direction parallel to the longitudinal axis 54, that is less than the lengths of the remaining guide vanes 44*b*, 44*c*, 44*d*. In particular, the length of the first guide vane 44*a* can be less than half the length of the other guide vanes 44*b*, 44*c*, 44*d*. Further, the length of the second guide vane 44*b* can be less than the length of the third and fourth guide vanes 44*c*, 44*d*, such that the trailing edges 48 of the first and second guide vanes 44*a*, 44*b* are located radially inward from the trailing edges 48 of the third and fourth guide vanes 44*c*, 44*d*. The radially inward locations of the trailing edges 48 of the first and second guide vanes 44*a*, 44*b* permits the air being redirected by the first and second guide vanes 44*a*, 44*b* to mix with circumferentially adjacent flows as it travels radially outward in the annular passage 23, which can facilitate uniformly distributed flow along the outside of the inner cylinder 24.

Figure 5:
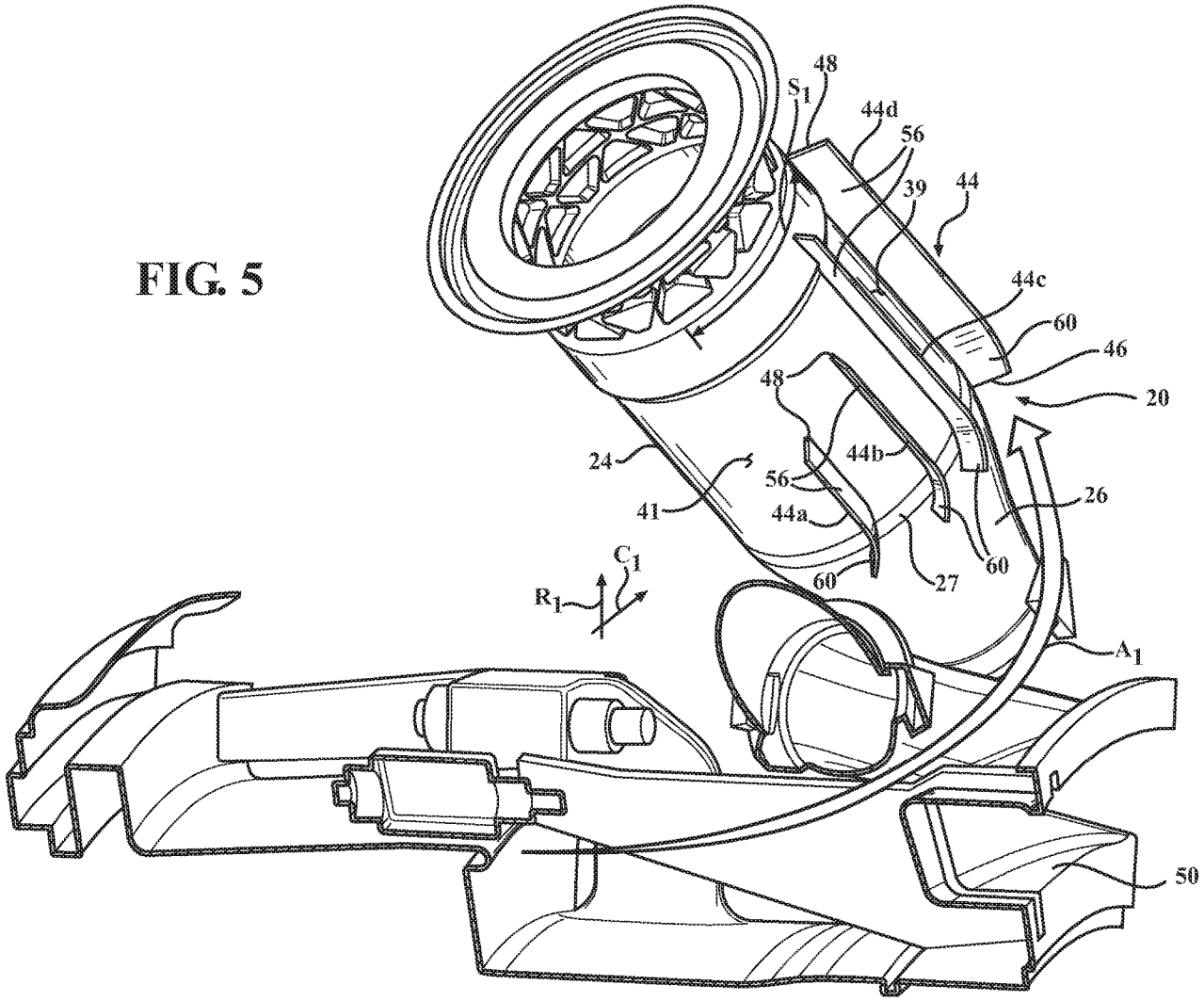
FIG. 5 is a perspective view of a combustor arrangement, shown with a flow sleeve removed, illustrating aspects of the invention including vanes having varying vane length.
Figure 6:
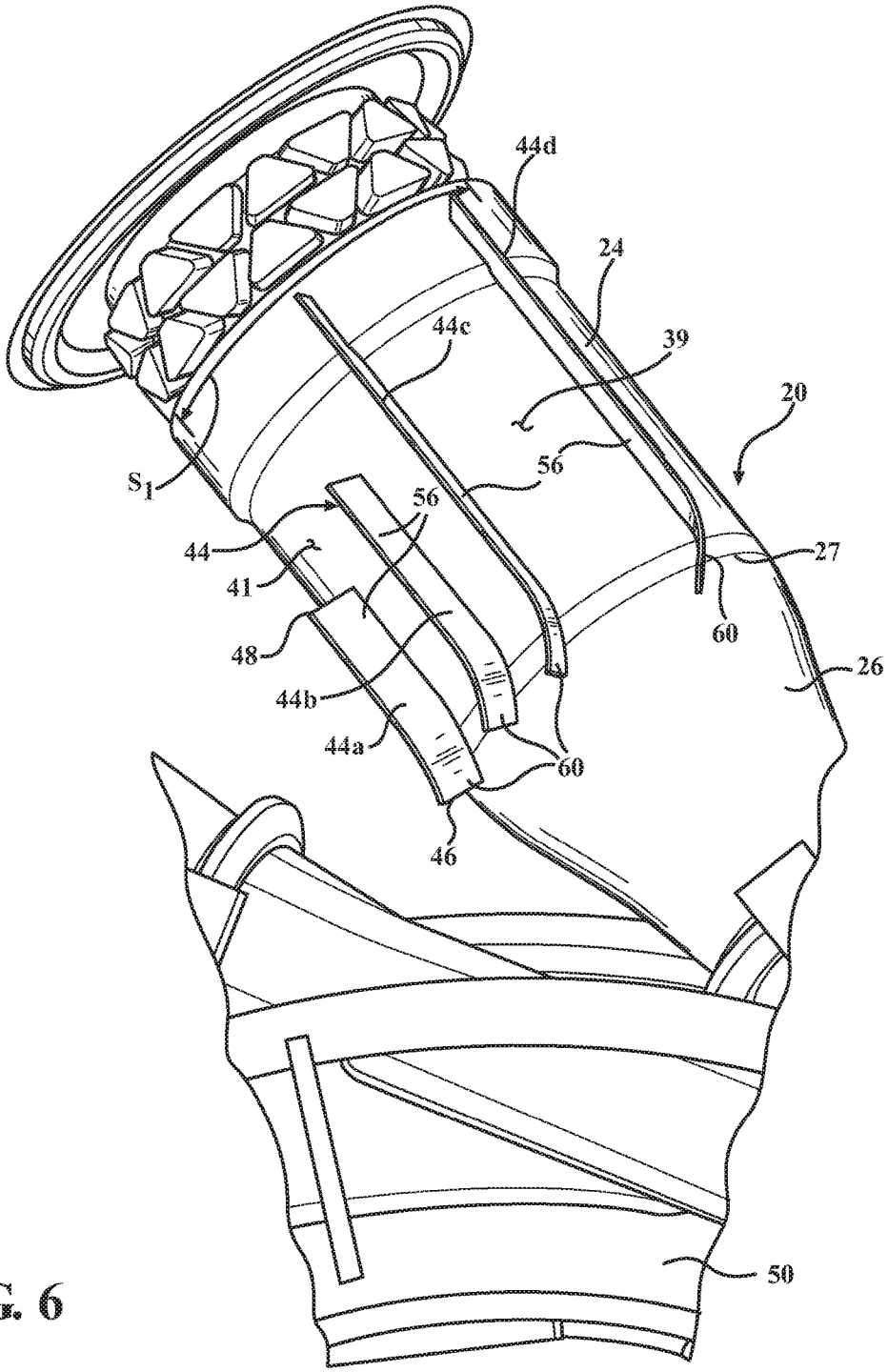
FIG. 6 is a perspective view of a combustor arrangement, shown with a flow sleeve removed, illustrating aspects of the invention including vanes having varying circumferential spacing and varying vane length.

FIGS. 4, 5 and 6 additionally illustrate that the circumferential spacing between guide vanes 44 can vary to provide control of the flow distribution through the annular passage 23. The circumferential spacing between guide vanes 44 can be defined as the spacing between the main bodies 56 of the vanes 44 and/or as the spacing between adjacent vanes 44, measured circumferentially around the combustor assembly 17, at a given axial location along the longitudinal axis 54.

Figure 7:
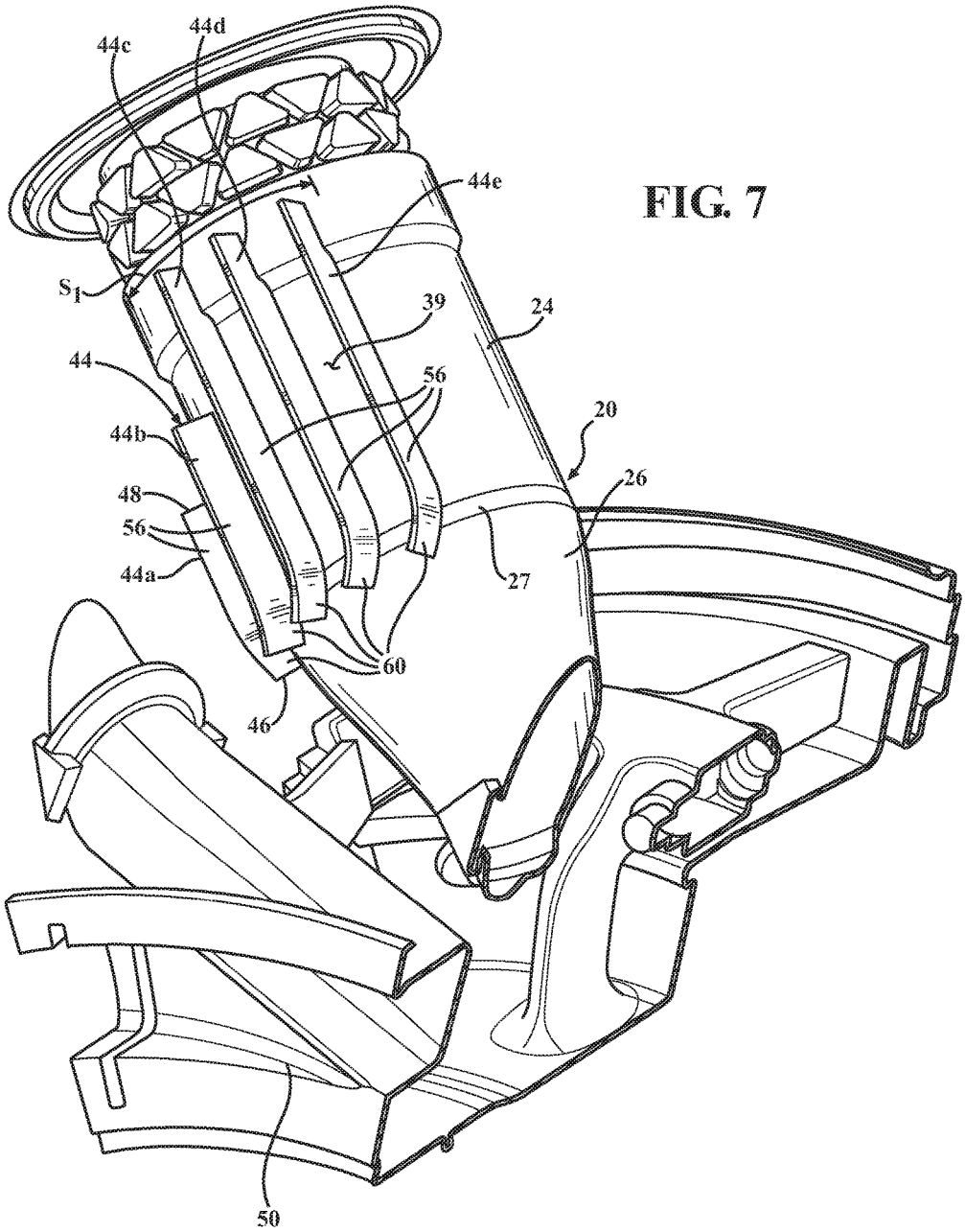
FIG. 7 is a perspective view of a combustor arrangement, shown with a flow sleeve removed, illustrating aspects of the invention including additional vanes and illustrating upstream vanes having varying vane length.

FIG. 4 shows the first pair of guide vanes 44 formed by the first and second guide vanes 44*a*, 44*b* being spaced closer than the second pair of guide vanes 44 formed by the third and fourth guide vanes 44*c*, 44*d*. FIG. 5 shows the first pair of guide vanes 44*a*, 44*b* being spaced generally the same as the spacing between the third and fourth guide vanes 44*c*, 44*d*, but with a closer spacing formed between the adjacent guide vanes 44*b*, 44*c* of the first and second pairs of guide vanes 44. FIG. 6 illustrates a further aspect of the invention in which the first and second vanes 44*a*, 44*b* are located in closer circumferentially spaced relation to each other than the spacing between the third and fourth guide vanes 44*c*, 44*d*. Further, FIG. 6 shows a configuration in which the fourth guide vane 44*d* is spaced a greater distance from the third guide vane 44*c* that the spacing between the other guide vanes 44*a*, 44*b*, 44*c*. FIG. 7 shows a further alternative configuration in which an additional guide vane may be provided, and a uniform circumferential spacing can be provided between adjacent vanes 44*a*-44*e*.

It may be understood that each of the variations to the vanes 44, as described above with reference to FIGS. 3-7, i.e., variations to the location of leading edges 46, lengths of vanes 44 and spacing of vanes 44, is configured to redistribute the flow around the annular passage 23. As noted above, the shell air flow is not uniformly distributed around the circumference of the combustor assembly 17 as is enters the annular passage 23, and tends to have a high concentration of air flow toward the aft side of the combustor assembly 17. In accordance with an aspect of the invention, the guide vanes 44 effect a greater uniformity in the distribution of the airflow around the circumference of the annular passage, while also reducing swirl in the flow.

In addition to increasing the uniformity and reducing swirl of the flow in the annular passage 23, the guide vanes 44 can facilitate cooling by conducting heat from the inner cylinder 24. In addition, the guide vanes 44 can function to support and maintain a spacing of the inner cylinder 24 relative to the flow sleeve 25.

It may be noted that although the flow control guide vanes 44, configured to turn the circumferential swirl flow to a longitudinally extending flow, are limited to the region $S_1$, additional structure (not shown) can be provided in the annular passage 23, extending between the inner cylinder 24 and the flow sleeve 25, located around the remaining circumferential regions of the combustor assembly 17 to provide support between the inner cylinder 24 and the flow sleeve 25. However, it should be understood that such additional structure would be configured to permit flow of air through the annular passage 23 without requiring the guide vane configuration described for the guide vanes 44.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A can annular gas turbine engine having a gas delivery structure for delivering gases from a plurality of combustors each having a longitudinal axis tangentially arranged with respect to a circumference defined by an annular chamber that extends circumferentially about a gas turbine engine axis for delivering the gas flow to a first row of blades, a gas flow path formed by a duct arrangement between a respective combustor of the plurality of combustors and the annular chamber for conveying gases in a downstream direction from the respective combustor to the first row of turbine blades, a combustor arrangement comprising:

the respective combustor having an inner cylinder surrounding a combustion zone of the combustor, the inner cylinder defining the longitudinal axis of the respective combustor that is tangentially arranged with respect to the circumference defined by the annular chamber;

a cone-shaped section having an inlet end receiving the gas flow from the inner cylinder, wherein the cone section defines a decreasing flow area in the downstream direction between the inlet end and an outlet end of the cone-shaped section;

a flow sleeve surrounding the inner cylinder;

an annular space defined between the inner cylinder and the flow sleeve and defining an air flow path having an annular air inlet defined along the inner cylinder radially inward along the longitudinal axis of a junction with respect to the gas turbine engine axis between the inner cylinder and the cone section; and a plurality of guide vanes located in circumferentially spaced relation to each other in the annular space, spanning between the flow sleeve and the inner cylinder, the guide vanes each having a length dimension defined between a radially inner leading edge and a radially outer trailing edge, wherein the leading edges of the guide vanes are located along the longitudinal axis radially inward with respect to the gas turbine engine axis from the junction between the inner cylinder and the cone section.

2. The combustor arrangement of claim 1, wherein the leading edge of at least one guide vane is located radially inward along the longitudinal axis relative to the leading edge of at least one other of the guide vanes with respect to the gas turbine engine axis.

3. The combustor arrangement of claim 2, wherein air flowing into the annular space has a circumferential swirl flow direction around a circumference of the inner cylinder, and the at least one guide vane is located in an upstream direction of the swirl flow from the at least one other of the guide vanes.

4. The combustor arrangement of claim 3, wherein at least two of the guide vanes have leading edges located radially inward along the longitudinal axis with respect to the gas turbine engine axis relative to at least two other of the guide vanes.

5. The combustor arrangement of claim 4, wherein the at least two of the guide vanes have trailing edges located radially inward along the longitudinal axis with respect to the gas turbine engine axis relative to the trailing edges of the at least two other guide vanes.

6. The combustor arrangement of claim 4, wherein a first guide vane of the plurality of guide vanes has a first leading edge which is located along the longitudinal axis radially inward of the leading edges of all the other guide vanes, and has a length that is less than half the length of the other guide vanes.

7. The combustor arrangement of claim 4, wherein a first guide vane is circumferentially located at an upstream-most location and is spaced from an adjacent guide vane a distance that is less than a circumferential spacing between other adjacent guide vanes.

8. The combustor arrangement of claim 4, wherein each of the guide vanes include a circumferentially angled flow directing portion and an angle of each of the circumferentially angled flow directing portions of the at least two guide vanes, as measured relative to the longitudinal axis, is greater than an angle of each of the circumferentially angled flow directing portions of the at least two other of the guide vanes.

9. The combustor arrangement of claim 1, wherein all of the guide vanes are located in a circumferential area that is less than 180 degrees around the circumference of the inner cylinder.

10. The combustor arrangement of claim 1, wherein a radially inner end of the flow sleeve is located radially inward along the longitudinal axis with respect to the gas turbine engine axis from the junction between the inner cylinder and the cone section.

11. The combustor arrangement of claim 1, wherein one or more of the guide vanes includes a straight main body aligned parallel to the longitudinal axis of the combustor and extending from the trailing edge to a radially inner intermediate location, and a circumferentially angled flow directing portion extending from the intermediate location to the leading edge.

12. A can annular gas turbine engine having a gas delivery structure for delivering gases from a plurality of combustors each having a longitudinal axis tangentially arranged with respect to a circumference defined by an annular chamber that extends circumferentially about a gas turbine engine axis for delivering the gas flow to a first row of blades, a gas flow path formed by a duct arrangement between a respective combustor of the plurality of combustors and the annular chamber for conveying gases in a downstream direction from the respective combustor to the first row of turbine blades, a combustor arrangement comprising:

the respective combustor having an inner cylinder surrounding a combustion zone of the combustor, the inner cylinder defining the longitudinal axis of the respective combustor that is tangentially arranged with respect to the circumference defined by the annular chamber;

a cone-shaped section having an inlet end receiving the gas flow from the inner cylinder, wherein the cone section defines a decreasing flow area in the downstream direction between the inlet end and an outlet end of the cone-shaped section;

a flow sleeve surrounding the inner cylinder;

an annular space defined between the inner cylinder and the flow sleeve and defining an air flow path having an annular air inlet defined along the inner cylinder radially inward along the longitudinal axis of a junction with respect to the gas turbine engine axis between the inner cylinder and the cone section; and a plurality of guide vanes located in circumferentially spaced relation to each other in the annular space, spanning between the flow sleeve and the inner cylinder, the guide vanes each having a length dimension defined between a radially inner leading edge and a radially outer trailing edge, wherein the leading edge of at least one guide vane is located radially inward along the longitudinal axis relative to the leading edge of at least one other of the guide vanes with respect to the gas turbine engine axis.

13. The combustor arrangement of claim 12, wherein air flowing into the annular space has a circumferential swirl flow direction around a circumference of the inner cylinder, and the at least one guide vane is located in an upstream direction of the swirl flow from the at least one other of the guide vanes.

14. The combustor arrangement of claim 13, wherein a first pair of the guide vanes have leading edges located radially inward along the longitudinal axis relative to a second pair of the guide vanes, and the first pair of guide vanes is located in the upstream direction of the swirl flow from the second pair of guide vanes.

15. The combustor arrangement of claim 14, wherein a first, upstream-most guide vane of the first pair of guide vanes has a length that is less than the length of the other guide vanes.

16. The combustor arrangement of claim 14, wherein each of the guide vanes include a circumferentially angled flow directing portion and an angle of the circumferentially angled flow directing portions of each of the guide vanes in the first pair of guide vanes, as measured relative to the longitudinal axis, is greater than an angle of each of the circumferentially angled flow directing portions of the guide vanes in the second pair of guide vanes.

17. A can annular gas turbine engine having a gas delivery structure for delivering gases from a plurality of combustors each having a longitudinal axis tangentially arranged with respect to a circumference defined by an annular chamber that extends circumferentially about a gas turbine engine axis for delivering the gas flow to a first row of blades, a gas flow path formed by a duct arrangement between a respective combustor of the plurality of combustors and the annular chamber for conveying gases in a downstream direction from the respective combustor to the first row of turbine blades, a combustor arrangement comprising:

the respective combustor having an inner cylinder surrounding a combustion zone of the combustor, the inner cylinder defining the longitudinal axis of the respective combustor that is tangentially arranged with respect to the circumference defined by the annular chamber;

a cone-shaped section having an inlet end receiving the gas flow from the inner cylinder, wherein the cone section defines a decreasing flow area in the downstream direction between the inlet end and an outlet end of the cone-shaped section;

a flow sleeve surrounding the inner cylinder;

an annular space defined between the inner cylinder and the flow sleeve and defining an air flow path having an annular air inlet defined along the inner cylinder radially inward along the longitudinal axis of a junction with respect to the gas turbine engine axis between the inner cylinder and the cone section;

a plurality of guide vanes located in circumferentially spaced relation to each other in the annular space, spanning between the flow sleeve and the inner cylinder, the guide vanes each having a length dimension defined between a radially inner leading edge and a radially outer trailing edge, each guide vane includes a circumferentially angled flow directing portion; and wherein air flowing into the annular space has a circumferential swirl flow direction around a circumference of the inner cylinder, and a first pair of guide vanes are circumferentially spaced apart a distance that is less than a circumferential spacing between a second pair of guide vanes adjacent to the first pair of guide vanes, the first pair of guide vanes being located in an upstream direction of the swirl flow relative to the second pair of guide vanes.

18. The combustor arrangement of claim 17, wherein leading edges of the first pair of guide vanes is located radially inward along the longitudinal axis from leading edges of the second pair of guide vanes with respect to the gas turbine engine axis.

19. The combustor arrangement of claim 18, wherein a first, upstream-most guide vane of the first pair of guide vanes has a length that is less than the length of the other guide vanes.

* * * * *